US005782120A

United States Patent [19]

Wright

[11] Patent Number: 5,782,120

[45] Date of Patent: Jul. 21, 1998

[54] CONTINUOUS EXTRUSION

[75] Inventor: Robert Rodger Wright, Dorchester, Great Britain

[73] Assignee: Holton Machinery Ltd., Bournemouth, United Kingdom

[21] Appl. No.: 666,336

[22] PCT Filed: Dec. 20, 1994

[86] PCT No.: PCT/GB94/02767

§ 371 Date: Aug. 8, 1996

§ 102(e) Date: Aug. 8, 1996

[87] PCT Pub. No.: WO95/17270

PCT Pub. Date: Jun. 29, 1995

[30] Foreign Application Priority Data

Dec. 21, 1993 [GB] United Kingdom ..... 9326050

[51] Int. Cl.[6] ..... B21B 9/00

[52] U.S. Cl. ..... 72/38; 72/262

[58] Field of Search ..... 72/38, 262

[56] References Cited

U.S. PATENT DOCUMENTS

| | | | |
|---|---|---|---|
| 4,316,373 | 2/1982 | Zilges et al. | 72/38 |
| 5,133,126 | 7/1992 | Matsuoka | 72/38 |

FOREIGN PATENT DOCUMENTS

| | | | |
|---|---|---|---|
| 50-24710 | 8/1975 | Japan | 72/38 |
| 58-218322 | 12/1983 | Japan | 72/262 |
| 59-125212 | 7/1984 | Japan | 72/38 |
| 61-165220 | 7/1986 | Japan | 72/38 |
| 62-289321 | 12/1987 | Japan | 72/262 |
| 2241660 | 9/1991 | United Kingdom | 72/262 |

*Primary Examiner*—Lowell A. Larson
*Assistant Examiner*—Ed Tolan
*Attorney, Agent, or Firm*—Fay, Sharpe, Beall, Fagan, Minnich & McKee

[57] ABSTRACT

A continuous extrusion machine has a rotatable wheel with a continuous groove in a wall. A fixed shoe structure associated with the wheel provides a passageway and an abutment on the shoe structure closes off one end of the passageway. An extrusion die leads from the passageway at or adjacent the abutment. The entire wheel is located within a hood which is sealed except for apertures for the feedstock, the extruded product and the flash which is removed from the groove. A gaseous, non-oxidizing atmosphere is provided in the hood at a pressure greater than the atmosphere outside the hood. This prevents oxide and other contaminants from entering into the extruded product.

16 Claims, 2 Drawing Sheets

CONTINUOUS EXTRUSION

Figure 1:
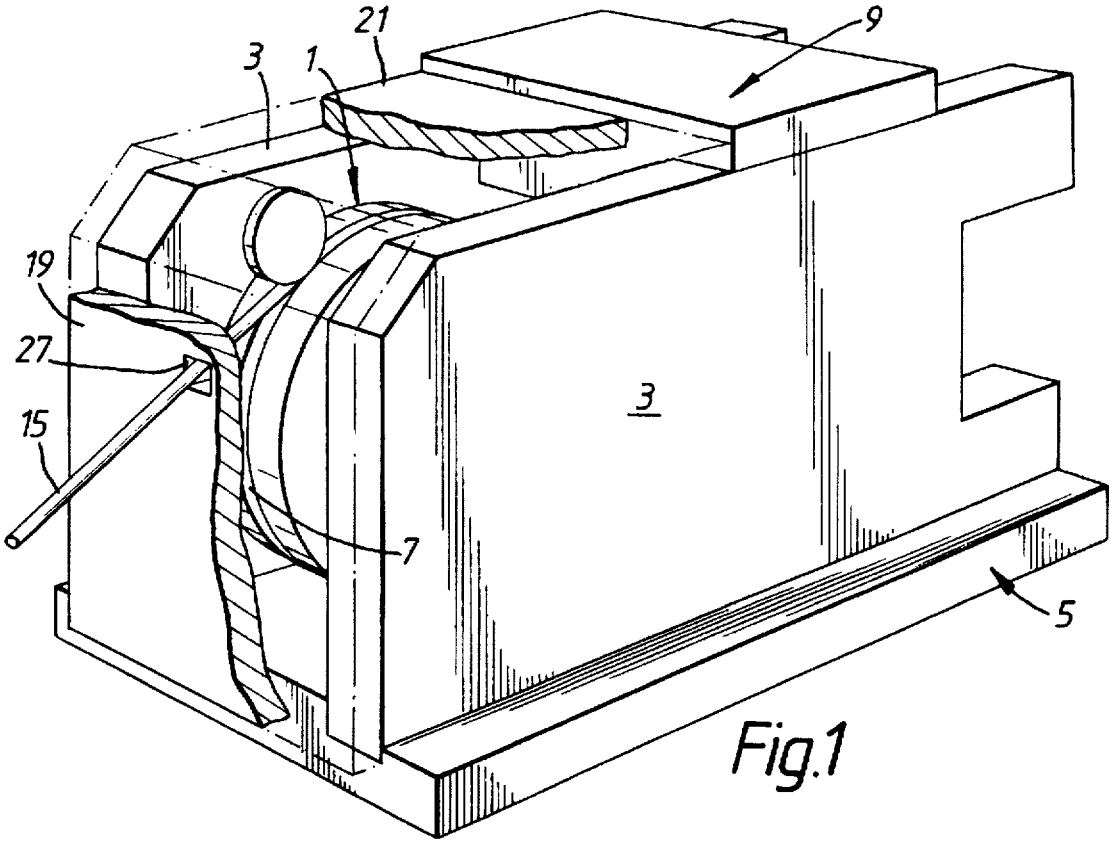

This invention relates to apparatus for continuously extruding metal. In particular the invention relates to a CONFORM machine.

British Patent Specification 1370894 describes a Conform machine. The machine basically comprises a rotatable wheel having an endless groove in its peripheral wall and a fixed shoe structure overlying the groove along part of its length to define a passageway therewith. The shoe member mounts a tooling assembly including an abutment which project into the groove to substantially close off the passageway and an extrusion die structure which extends out from the passageway at or upstream of the abutment. In use, a metal feedstock, such as copper or aluminiun, and conveniently in the form of a rod is fed into tile non-closed end of the passageway. The feedstock is drawn continuously by the rotating wheel along the passageway where it is heated by frictional engagement with the walls of the passageway. The metal impinges against the abutment and it leaves the passageway through the extrusion die structure in the form of a continuously extruded product.

It will be appreciated that when the metal from the feedstock flows through the extrusion die structure, some of the surface parts or the feedstock before deformation will be present inside the extruded product. Aluminiumn and copper readily undergo surface oxidation and if oxide contaminants on the feedback become entrained within the extruded product this can reduce the formability of the product and may cause blister defects on the surface of the product. Generally, the inclusion of oxide contaminants may make the product unacceptable to some potential customers.

An attempt to overcome this difficulty is described in EP-B-0074692. This specification discloses a conform machine for extruding non-ferrous metal feedstock and which is in combination with apparatus for continuously pre-treating the feedstock immediately before it enters the Conform machine. The pre-treatment comprises spraying the feedstock with a liquid deoxidation and cleaning agent. This agent removes the surface oxidation coating on the feedstock and the feedstock is subsequently rinsed and dried before it enters the Conform machine.

Since, the feedstock metal, e.g. copper and aluminium, is prone to oxidation it readily oxidises during the time it is within the Conform machine before it passes through the extrusion die. Thus even if the feedstock is thoroughly cleaned to remove surface contaminant before it enters the conform machine, additional surface oxidation can occur in the machine before the feedstock is extruded and some of this oxide can be contained within the extruded product.

GD-B-2241660 addresses this problem and it is stated in the specification that a reducing gaseous environment can be arranged in and about the passageway which receives the feedstock in a conform machine. To this end a jet or jets are arranged to direct reducing gas into the groove immediately before the introduction of the feedstock. By this procedure, oxidation of the feedstock in the machine is almost entirely eliminated.

During the operation of the Conform machine a small amount of metal is extruded between the abutment and the walls of the groove. This metal is made up of two parts, 'flash' or metal which is ejected from the groove and a film of metal which forms a tire within the wheel groove. Both the flash and the tire are easily oxidised and will contaminate new clean feedstock entering the groove. As much as possible of the flash is usually removed by a scraper placed down stream of the abutment and before the flash re-enters the groove. However, even with efficient scraper operation some small pieces of flash will remain in the groove. The tire is not removed by the scraper operation. Both the remaining pieces of oxidised flash and the oxidized tire in the groove will contaminate the clean feedstock entering into the groove.

This problem of oxidised flash remaining in the groove has also been considered in GB-B-2241660 and to overcome the problem it is promised to arrange a crescent-shaped spray housing over the exposed part of the groove, not covered by the shoe member dull to direct reducing gas into the groove by way of spaced apart jets.

These prior art methods of spraying reducing gas into the groove or a Conform machine both before and after the abutment do not completely remove all the oxygen from the groove and come unwanted oxidation of the feedstock and/or the flash occurs.

It is an object of the present invention to provide a continuous extrusion apparatus of the Conform type in which the above described difficulties are more readily overcome.

Accordingly to the present invention continuous extrusion apparatus comprises a rotatable wheel having an endless groove in a wall thereof, a fixed shoe structure covering the groove along part of its length to define a passageway therewith, and having an abutment which projects into the groove to substantially close off the passageway and an extrusion die structure leading from the closed off passageway at or upstream or the abutment, characterised in that at least the entire wheel is located within a hood, means arc provided for introducing a non-oxidising gaseous protection atmosphere into the hood, the hood has at least one aperture for the introduction of the metal feedstock, an aperture for the discharge of the extruded product and an aperture for the discharge of flash removed from the groove, said apertures being arranged such that, in use, the flow of the non-oxidising atmosphere therethrough out of the hood is limited so that the non-oxidising gaseous atmosphere in the hood is at a greater pressure than the atmosphere outside of the hood.

The wheel is rotatably mounted in a fixed structure and the structure may form part of the hood. Similarly, the fixed shoe structure may torn part of the hood.

The non-oxidising gaseous protection atmosphere may be an inert gas such as argon or nitrogen which is considered to be inert, or a mixture of inert and reducing gases, such as a mixture of nitrogen and hydrogen.

The hood encloses the entire wheel and the drive shaft for rotating the wheel passes through gas-tight bearings so that the drive motor is outside of the hood. Thus the hood has to have at least one aperture for the introduction of the metal feedstock, one form of aperture is required if the feedstock is of alongate continuous form and a separate aperture is usually provided if the feedstock is of particulate form. Another aperture is required in the hood to allow the egress of the extruded product. Flash has to be removed from the hood. The flash is scraped or otherwise removed from the groove and it collects in a chamber usually at the lowest part of the hood. Means for reducing the flash into short lengths may be provided in the hood. An aperture in the hood is provided to enable the flash to be continuously or periodically removed from the chamber in the hood. Steps are taken to limit the flow of the gaseous atmosphere out of the hood through the apertures so that in accordance with the invention, the non-oxidising gaseous atmosphere in the hood is at a greater pressure than the atmosphere outside of the hood. Clearly there will be some flow of non-oxidising atmosphere out of the hood through the apertures but this is compensated by the inflow of non-oxidising gas into the hood.

As the entire wheel is within the non-oxidising atmosphere in the hood, there is no oxidation of the feedstock after it enters the hood and there is no oxidation of the flash in the groove consequently as a result of this invention an extruded product is obtained which has superior metallurgical characteristics as compared with extruded products produced by the prior art apparatus.

Figure 2:
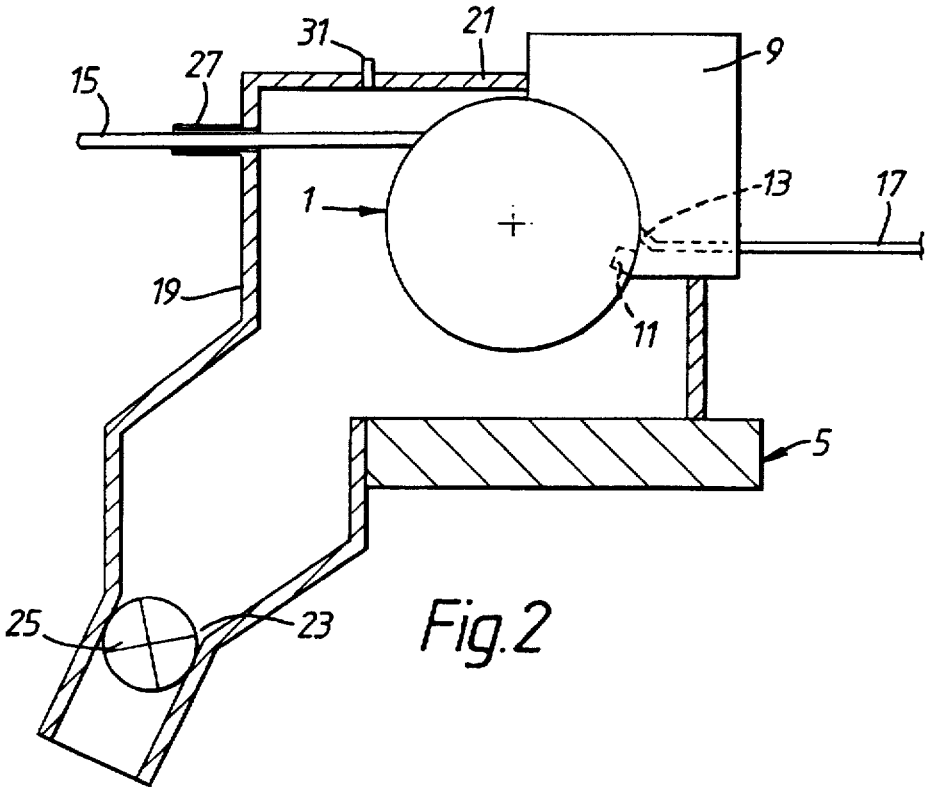
Figure 3:
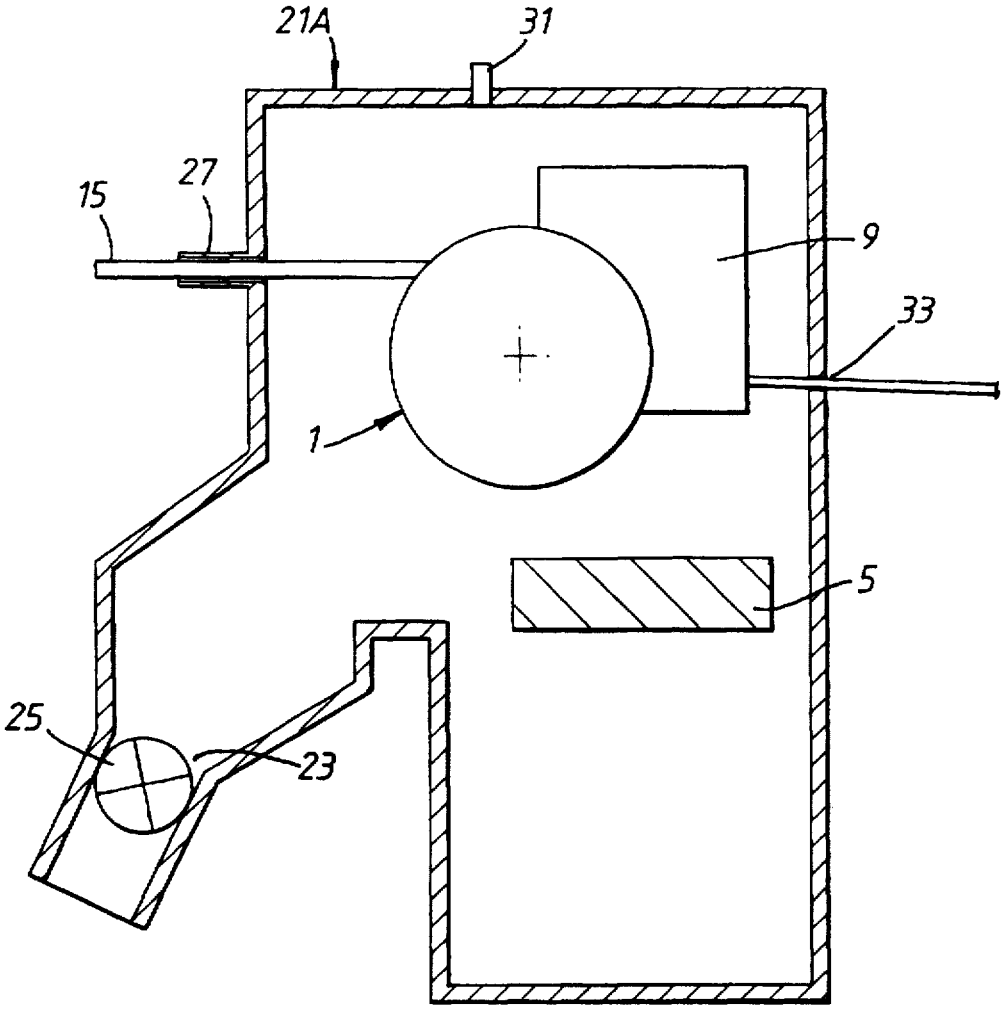

In order that the invention may be more readily understood it will now be described, by way of a typical example only, with reference to the accompanying drawing in which:

FIG. 1 is a simplified perspective view of a Conform machine in accordance with one embodiment of the invention and FIG. 2 is a diagrammatic sectional side elevation of a Conform machine similar to that shown in FIG. 1 and FIG. 3 is a diagrammatic sectional side elevation of a Conform machine according to another embodiment of the invention.

A Conform machine has a wheel 1 rotatably mounted on a horizontal drive shaft which is mounted in bearings in a pair or side plates 3 which form part of a fixed structure 5. The wheel is rotated by ail electric motor (not shown) which is connected to the drive shaft. The wheel ties a continuous groove 7 in its peripheral wall. A shoe structure 9 is mounted on the side plate 3 and the shoe structure overlies the groove 7 along part of its length to define a passageway. The shoe structure also has an abutment 11 which projects into the groove to substantially close off the passageway. There is also an extrusion die structure 13, which usually forms part of the shoe structure, and which extends from the passageway to the outside of the shoe. This die leads from the passageway at or slightly upstream of the abutment. As is well known, the Conform machine operates by rotating the wheel and introducing a metal feedstock into the end of the passageway which is remote from the abutment. The feedstock is drawn by friction with the walls of the rotating wheel along the passageway and into impingement with the abutment. The metal is softened sufficiently for it to be extruded from the passageway through the extrusion die 13 to produce an extruded product. The feedstock may be an elongate solid material as indicated by reference numeral 15 in the figures or it may be of particulate form. The extruded product is indicated by reference numeral 17.

In accordance with the present invention, the entire wheel is located within a hood and a non-oxidizing gaseous atmosphere is retained in the hood at a pressure which is greater than the atmosphere outside of the hood. As shown in FIGS. 1 and 2 the fixed structure 5 and the shoe structure 9 form part of the hood. The hood also includes front and top panels 19 and 21 respectively which are sealed to the side walls 3 and the shoe structure 9. As shown in FIG. 2, the front panel 19 is modified to define an aperture 23 at the base of the hood through which flash removed from the groove in the wheel can be removed from the hood. A rotary valve 25 is located in the aperture 23 to normally close-off the aperture but, on rotation of the valve,flash can be removed from the hood. Means not shown may be provided within the hood for breaking up the flash into portions which can readily be removed through the valve 25.

The hood also has an aperture 27 in the front panel through which the feedstock can enter into the hood. The aperture may be dimensioned so that it is only slightly larger than the cross-section of the feedstock which is intended to pass through it. Alternatively an aperture of variable size may be provided in order to accommodate feedstocks of different sizes but in evenly case, steps are taken to ensure that the space around feedstock passing through the aperture is reduced as far as practical in order to limit the flow of gaseous atmosphere out through the aperture. A further aperture may be provided in the panel 21, above the wheel to allow participate feedstock to enter into the passageway. Again, steps are taken to limit the egress of gaseous atmosphere through this aperture.

In the FIG. 3 embodiment, the entire wheel 1, the shoe structure 9, and the fixed structure 5 are located within the hood. As compared with the FIGS. 1 and 2 embodiment, the top panel 21A is extended over the wheel and the shoe and a back panel 31 is connected to the top panel 21A and a base to form the hood. An aperture 33 is provided in the back panel to allow the extruded product 17 to leave the hood.

It is convenient for the cross-section of this aperture to be only slightly greater than the cross-station of the extruded product to limit the egress of gaseous atmosphere.

In all embodiments of the invention the hood is sealed apart from the apertures mentioned above, and steps are taken to limit the flow or gas out of the hood through these apertures, it is economically possible to continuously supply a non-oxidising gaseous protection atmosphere into the hood through one or more inlets such as indicated by reference numeral 31, so that the pressure in the hood is greater by 1–100 mm $H_2O$, conveniently, 2–20 mm $H_2O$ than the pressure outside of the hood.

The non-oxidising atmosphere in the hood may be an inert gas, e.g. argon, nitrogen or a mixture or inert and reducing gas, such as for example 95% nitrogen and 5% hydrogen.

It is convenient for the feedstock to ba cleaned to remove surface contaminants before it enters the conform machine it is preferable that the cleaning process takes place synchronously with the drawing of the feedstock into the machine. It will be appreciated therefore that in such a case, the feedstock leaving the cleaning aperture will pass through a tube or duct which leads to the aperture 27 in the hood. The tube or duct may be filled with a non-oxidising atmosphere.

I claim:

1. Continuous extrusion apparatus comprising a rotatable wheel (1) having an endless groove (7) in a wall thereof, a fixed shoe structure (9) covering the groove along part of its length to define a passageway therewith, and having an abutment (11) which projects into the groove to substantially close off the passageway and an extrusion die structure (13) leading from the closed off passageway at or upstream of the abutment, characterised in that at least the entire wheel (11) is located within a hood having a normally closed aperture (23) for the discharge of flash removed from the groove, an aperture (27) for the introduction of the metal feedstock (15) and an aperture (33) for the discharge of the extruded product (17), the cross-sectional dimensions of the feedstock aperture (27) and the product aperture (33) being such that, in use, with the feedstock and the extruded product respectively passing therethrough the flow of a gas therethrough out of the hood is limited, and means (31) for introducing a non-oxidising gaseous protection atmosphere into the hood at a rate greater than the flow of non-oxidising gaseous protection atmosphere out of the hood.

2. Continuous extrusion apparatus as claimed in claim 1 characterised in that the wheel is rotatably mounted in a fixed structure and that the structure forms part of the hood.

3. Continuous extrusion apparatus as claimed in claim 1 characterized in that the fixed shoe structure forms part of the hood.

4. Continuous extrusion apparatus as claimed in claim 1 characterized in that the gaseous atmosphere is an inert gas.

5. Continuous extrusion apparatus as claimed in claim 1 characterized in that the gaseous atmosphere is a mixture of inert and reducing gases.

6. Continuous extrusion apparatus as claimed in claim 1 characterized in that the gaseous atmosphere is a mixture of nitrogen and hydrogen.

7. A method of operating continuous extrusion apparatus as claimed in claim 1 in which the gaseous atmosphere is a mixture of nitrogen and hydrogen.

8. Continuous extrusion apparatus as claimed in claim 1 characterized in that the pressure of the atmosphere inside the hood is in the range of 1–100 mm $H_2O$. greater than the pressure outside of the hood.

9. A method of operating continuous extrusion apparatus as claimed in claim 8 in which the pressure in the hood is in the range 2–20 mm $H_2O$ greater than the pressure outside of the hood.

10. A continuous extrusion apparatus comprising:

a hood;

a rotatable wheel having an endless groove in a wall thereof, wherein said wheel is mounted within said hood so that said hood completely encloses said wheel;

an extrusion die structure mounted adjacent said wheel;

a first aperture located in said hood for the introduction of a metal feedstock to said wheel;

a second aperture located in said hood for the discharge of extruded product from said wheel, wherein said second aperture is spaced from said first aperture; and a selectively openable third aperture located in said hood for the discharge of flash removed from the groove, said third aperture being spaced from said first and second apertures.

11. The continuous extrusion apparatus of claim 10 further comprising a fixed shoe structure covering the groove of said wheel along a part of the groove to define a passageway therewith and including an abutment which projects into the groove to substantially close off the passageway.

12. The continuous extrusion apparatus of claim 10 further comprising a valve positioned in said third aperture for selectively opening and closing said third aperture.

13. The continuous extrusion aperture of claim 10 further comprising a means for introducing a gaseous protection atmosphere into said hood.

14. The continuous extrusion apparatus of claim 10 further comprising a fixed structure which forms part of said hood and wherein the wheel is rotatably mounted in said fixed structure.

15. The continuous extrusion apparatus of claim 10 further comprising a fixed shoe structure which forms part of said hood.

16. The continuous extrusion apparatus of claim 10 further comprising a means for cleaning the surface of the feedstock, said means for cleaning being located upstream of said first aperture.

* * * * *